United States Patent [19]

Shimamura et al.

[11] Patent Number: 4,683,860

[45] Date of Patent: Aug. 4, 1987

[54] DEVICE FOR CONTROLLING THE INCREASED FUEL SUPPLY FOR ENGINES

[75] Inventors: Haruo Shimamura; Hideo Kobayashi; Masahiko Asakura, all of Saitama, Japan

[73] Assignee: Honda Giken Kogyo Kabushiki Kaisha, Tokyo, Japan

[21] Appl. No.: 804,304

[22] Filed: Dec. 3, 1985

[30] Foreign Application Priority Data

Dec. 3, 1984 [JP] Japan ..... 59-254202

[51] Int. Cl.[4] ..... F02M 7/12

[52] U.S. Cl. ..... 123/492; 123/438

[58] Field of Search ..... 123/438, 439, 492; 261/34 A, DIG. 74

[56] References Cited

U.S. PATENT DOCUMENTS

| | | | |
|---|---|---|---|
| 3,744,346 | 7/1973 | Minck | 123/438 |
| 4,266,522 | 5/1981 | Williams | 123/492 |
| 4,563,990 | 1/1986 | Kishida | 123/439 |

*Primary Examiner*—Ronald B. Cox
*Attorney, Agent, or Firm*—Lyon & Lyon

[57] ABSTRACT

A device for increasing an amount of fuel to be supplied to an engine includes a fuel increasing mechanism for supplying an added amount of fuel to the engine, and an electric control circuit including a low-temperature sensor for detecting a low temperature of the engine to produce a first signal capable of actuating the fuel increasing mechanism, and a neutral-gear-condition detector for detecting the neutral-gear-condition of a gear transmission associated with the engine to produce a second signal. The fuel increasing mechanism is inactivated in response to the second signal from the neutral-gear-condition sensor by overriding the low-temperature sensor to prevent the increase of fuel while the gear transmission is in neutral. A second embodiment employs additional sensors for air temperature, engine r.p.m., vehicle speed and the park-condition of an automatic transmission also for controlling the fuel increase.

12 Claims, 3 Drawing Figures

DEVICE FOR CONTROLLING THE INCREASED FUEL SUPPLY FOR ENGINES

The present invention relates to a device for controlling the supply of fuel to an automotive engine and, in particular, for supplying an increased amount of fuel to the automotive engine under specific operating conditions.

There are numerous prior art devices for increasing the normal fuel supply while an internal combustion engine is warming up to prevent stalling and improve the engine operation. One such device for supplying fuel an increased quantity of fuel to a cold engine has a sensor for detecting a low temperature condition of the engine and a fuel increasing mechanism responsive to the operation of the low-temperature sensor for feeding an increased amount of fuel to the engine while the engine is still cold. With such a device, the drivability of the automobile is improved when the automobile is operated while the engine remains cold. However, with the fuel increasing mechanism in operation while the engine is idling, the ignition plugs will tend to get wet with too rich an air-fuel mixture and produce a weak spark which cannot fully ignite the fuel, thereby leading to misfiring. Thus, such conventional device has the disadvantage of operating the fuel increasing mechanism when the engine is cold even if the engine is left idling.

It is an object of the present invention to provide a device for supplying an increased amount of fuel to an engine, which device has means for preventing the fuel increasing mechanism from operating even when the engine is cold if the gear transmission coupled to the engine is in a neutral gear position.

According to the present invention, a device for increasing the amount of fuel to be supplied to an engine includes a fuel increasing mechanism for supplying an added amount of fuel to the engine, and an electric control circuit including a low-temperature sensor for detecting a low temperature of the engine to produce a first signal capable of actuating the fuel increasing mechanism, a neutral-gear-condition detector for detecting the neutral-gear condition of a gear transmission associated with the engine to produce a second signal, and means responsive to the second signal for inactivating the fuel increasing mechanism by overriding the low-temperature sensor.

When the automobile is started while the engine is cold, the fuel increasing mechanism is operated to provide the engine with an additional amount of fuel. If the engine is left idling, the fuel increasing mechanism is rendered inoperative by the neutral-gear-condition detector to thereby prevent the ignition plugs from getting wet with fuel and causing incomplete ignition of the air-fuel mixture.

The above and other objects, features and advantages of the present invention will become more apparent from the following description when taken in conjunction with the accompanying drawings in which preferred embodiments of the present invention are shown by way of illustrative example.

Figure 1:
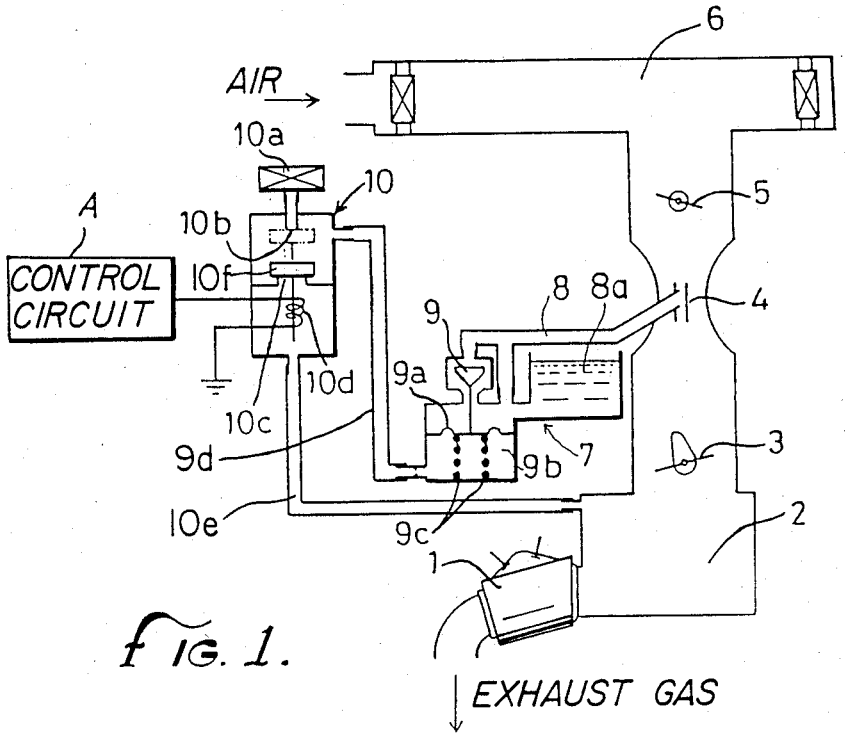
FIG. 1 is a schematic view of a device for increasing fuel supply to an engine according to the present invention.

Referring now to FIG. 1, there is schematically shown an internal combustion engine, generally designated 1, with an intake manifold 2 connected to a carburetor 4 having a throttle valve 3 and a choke valve 5 therein. The carburetor 4 is coupled to an air cleaner 6.

The device of the present invention includes a fuel increasing mechanism 7, generally designated, comprised of a fuel supply valve 9 connected by a fuel passage 8 to the carburetor 4 and communicating with a fuel tank 8*a*, and a control valve 10 for controlling the opening and closing of the fuel supply valve 9.

The fuel supply valve 9 is of the vacuum-responsive type operatively coupled to a diaphragm 9*a* defining a vacuum chamber 9*b* on one side thereof. When a vacuum in excess of a prescribed level is developed in the vacuum chamber 9*b*, the diaphragm 9*a* is displaced downwardly in FIG. 1 against the force of a spring 9*c* to close the fuel supply valve 9 for thereby cutting off the fuel flow from the fuel tank 8*a* through the valve 9 into the fuel passage 8. The vacuum chamber 9*b* is connected through a control passage 9*d* to the control valve 10. The control valve 10 operates either to vent the control passage 9*d* to the atmosphere or to connect the control passage 9*d* to the intake manifold 2. More specifically, the control valve 10 comprises a solenoid-operated valve having an atmospheric port 10*b* communicating through an air filter 10*a* with the atmosphere and a vacuum port 10*c* communicating through a vacuum passage 10*e* with the intake manifold 2. The control valve 10 has a valve body 10*f* movable between a first position in which it closes the atmospheric port 10*b* and a second position in which it closes the vacuum port 10*c*, the valve body 10*f* being drivable by a solenoid 10*d* electrically connected to an electric control circuit A. When the solenoid 10*d* is energized by the control circuit A, the valve body 10*f* is moved to the broken-line position to close the atmospheric port 10*b*, thereby connecting the control passage 9*d*, i.e., the vacuum chamber 9*b* to the vacuum port 10*c*, i.e., the intake manifold 2. When the solenoid 10*d* is deenergized by the control circuit A, the valve body 10*f* is moved to the solid-line position to close the vacuum port 10*c*, thus connecting the vacuum chamber 9*b* to the atmospheric port 10*b*. Therefore, as long as the solenoid 10*d* is deenergized, atmospheric pressure is introduced into the vacuum chamber 9*b* and the fuel supply valve 9 is opened to supply an added amount of fuel from the fuel tank 8*a* into the carburetor 4, even if the vacuum in the intake manifold 2 is relatively high, such as when the engine is in low-load operation including an engine idling mode.

Figure 2:
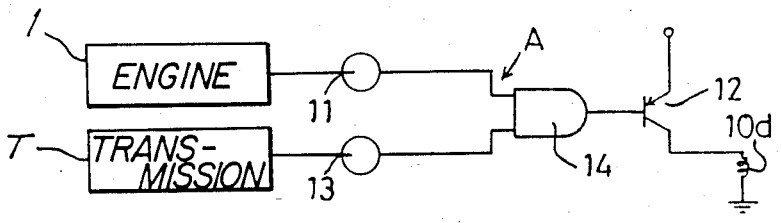
FIG. 2 is a block diagram of a control circuit of the device shown in FIG. 1.

One form of the control circuit A is shown in detail in FIG. 2. The control circuit A has a low-temperature sensor 11 for detecting a low temperature of the engine 1, a neutral-gear-condition detector 13 for detecting the neutral-gear position selected by a gear transmission T associated with the engine 1, an AND gate 14 having its two input terminals connected to the low-temperature sensor 11 and the neutral-gear detector 13, respectively, and a switching element 12 comprising a transistor connected to the output of the AND gate 14 and also connected in series with the solenoid 10*d*.

More specifically, the low-temperature sensor 11 generates a high-level signal when the temperature of cooling water of the engine 1 is lower than a certain temperature such as 60° C. The neutral-gear detector 13 produces a low-level signal when it detects the neutral-gear position of the shift lever of the gear transmission T. The switching transistor 12 has a base connected to the output terminal of the AND gate 14, and is rendered conductive in response to a low-level signal applied to the base. Therefore, whenever the gear transmission T is not in the neutral-gear position, the neutral-gear detector 13 generates a high-level signal and the AND gate 14 will apply a high-level signal to the switching transistor 12 to render the same nonconductive, assuming that the output signal from the low-temperature sensor 11 remains high. When the neutral gear is selected, the output signal of the neutral-gear detector 13 changes to a low signal to make the output signal of the AND gate 14 low regardless of the output signal of the low-temperature sensor 11, thus energizing the switching transistor 12. Thus, while the engine is idling, the solenoid 10*d* is energized to bring the vacuum chamber 9 into communication with the intake manifold 2 for thereby closing the fuel supply valve 9.

Operation of the device according to the present invention is as follows: When the engine is cold and idling with the gear transmission in the neutral gear position, the output signal from the neutral-gear detector 13 is low to energize the switching transistor 12. The solenoid 10*d* is energized to shift the valve body 10*f* upwardly, as shown in FIG. 1, to close the atmospheric port 10*b*, whereupon the vacuum is introduced from the intake manifold 2 into the vacuum chamber 9*b*. Since the vacuum from the intake manifold 2 is relatively high while the engine is idling, the fuel supply valve 9 is closed to prevent fuel from being additionally supplied from the fuel tank 8*a* to the carburetor 4 through the fuel increasing mechanism 7. Therefore, the ignition plugs (not shown) in the engine 1 are prevented from getting excessively wet with fuel resulting in a weak ignition during the idling mode of the engine.

By shifting the gear transmission from the neutral gear to the low gear, for example, the output signal from the neutral-gear detector 13 goes high to turn off the switching transistor 12. The solenoid 10*d* is then deenergized to introduce the atmospheric pressure into the vacuum chamber 9*b*, thereby opening the fuel supply valve 9. Additional fuel is therefore supplied from the fuel tank 8*a* through the fuel increasing mechanism 7 into the carburetor 4 regardless of the vacuum in the intake manifold 2. Accordingly, the drivability of the automobile is improved when it is operated while the engine is still cold.

Figure 3:
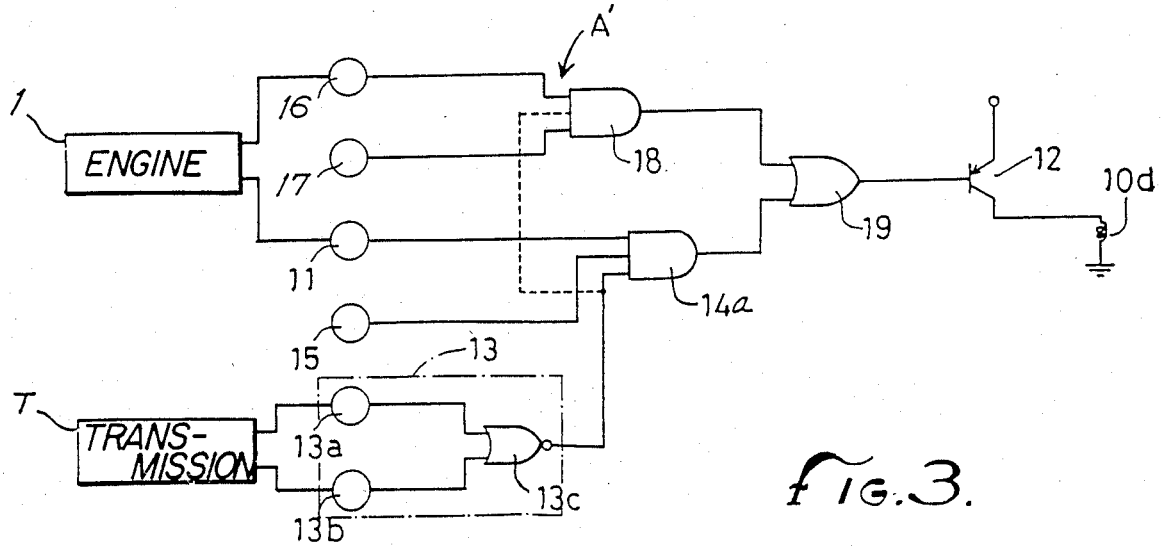
FIG. 3 is a block diagram of a control circuit according to another embodiment of the present invention.

FIG. 3 shows an electric control circuit A′ according to another embodiment of the present invention. The control circuit A′ is designed for use with an automatic gear transmission T′ in which the neutral-gear condition can be detected as a neutral-gear position or a parking-gear position. The control circuit A′ includes a neutral-gear-condition detector 13′ composed of a neutral-gear detector 13*a* for detecting the neutral-gear position of the shift lever of the automatic gear transmission T′ to produce a high level signal, a parking-position detector 13*b* for detecting the parking-gear position of the shift lever to produce a high-level signal, and a NOR gate 13*c* having two input terminals connected respectively to the detectors 13*a*, 13*b*. As a consequence, only when the shift lever is in neither the neutral-gear position nor the parking-gear position, the NOR gate 13*c* applies a high-level signal to an AND gate 14*a*.

The AND gate 14*a* has its three input terminals connected to (1) the NOR gate 13*c*, (2) the low-temperature sensor 11, and (3) a car-speed sensor 15 which produces a low-level signal when the speed of the automobile exceeds a certain value such as 20 km/h. The control circuit shown in FIG. 3 additionally includes an engine r.p.m. sensor 16 and an intake-air temperature sensor 17 which are coupled to input terminals of an AND gate 18. The engine r.p.m. sensor 16 generates a high-level signal when the temperature of intake air is below a certain temperature such as 18° C., and the engine r.p.m. sensor 17 generates a high-level signal when the r.p.m of the engine is below a certain speed such as 3,000 r.p.m. The AND gates 14*a*, 18 have their output terminals connected to the input terminals of an OR gate 19 with its output terminal coupled to the base of the switching transistor 12 connected in series with the solenoid 10*d*.

If the intake-air temperature is below 18° C. and the engine r.p.m. is lower than 3,000 r.p.m., then the AND gate 18 applies a high-level signal to the base of the switching transistor 12 through the OR gate 19 irrespectively of whether the automatic gear transmission T′ is in the neutral-gear condition or not. The switching transistor 12 is then deenergized to operate the fuel increasing mechanism 7 (FIG. 1) for supplying an additional amount of fuel to the carburetor 4. The low-temperature sensor 11 and the neutral-gear-condition detector 13′ produce a high-level signals after the automobile has started moving with the engine cold. If the automobile speed exceeds 20 km/h at this time, then the signal from the car-speed sensor 15 goes low making the output signal from the AND gate 14*a* low. If the temperature of the intake air becomes higher than 18° C. also at this time, then the signal from the intake-air temperature sensor 17 goes low thereby to render the output signal of the AND gate 18 low. Therefore, the base of the switching transistor 12 is supplied with a low-level signal to render the switching transistor 12 conductive, thus energizing the solenoid 10*d*. The fuel increasing mechanism 7 is now caused to stop its operation. As a consequence, no additional fuel is fed to the carburetor 4 through the fuel increasing mechanism 7 for thereby preventing increased engine emissions and reduced fuel economy.

As indicated by the dotted lines in FIG. 3, the output terminal of the neutral-gear-condition detector 13′ may be connected also to an input terminal of the AND gate 18 such that the fuel increasing mechanism 7 will be rendered inoperative if the automatic gear transmission T′ is in the neutral gear condition even when the intake-air temperature is lower than 18° C. and the engine r.p.m. is below 3,000 r.p.m.

Although certain preferred embodiments have been shown and described, it should be understood that many changes and modifications may be made therein without departing from the scope of the appended claims.

What is claimed:

1. A device for increasing an amount of fuel to be supplied to an engine associated with a gear transmission, comprising:

a fuel increasing mechanism for supplying an added amount of fuel to the engine; and an electric control circuit including a low-temperature sensor for detecting a low temperature of the engine to produce a first signal capable of actuating said fuel increasing mechanism, a neutral-gear-condition detector for detecting the neutral-gear condition of the gear transmission to produce a second signal, and means responsive to said second signal for inactivating said fuel increasing mechanism by overriding said low-temperature sensor.

2. A device according to claim 1, wherein said fuel increasing mechanism includes a vacuum-responsive fuel supply valve for supplying the added amount of fuel to the engine, a diaphragm coupled to said vacuum-responsive fuel supply valve and movable to close said vacuum-responsive fuel supply valve under a vacuum developed in a vacuum chamber defined adjacent to said diaphragm, and a control valve actuatable by said electric control circuit selectively for venting said vacuum chamber to the atmosphere to open said vacuum-responsive fuel supply valve and for introducing the vacuum into said vacuum chamber to close said vacuum-responsive fuel supply valve.

3. A device according to claim 2, wherein said control valve comprises a solenoid-operated valve having a solenoid, said means of said electric control circuit including an AND gate having input terminals connected to said low-temperature sensor and said neutral-gear-condition detector, and a switching element connected to said solenoid and controllable by said AND gate.

4. A device according to claim 3, wherein said switching element comprises a transistor having a base connected to the output terminal of said AND gate, said first and second signals being high and low, respectively, in level, said transistor being energizable by a low-level signal applied by said AND gate to the base thereof to energize said solenoid for causing said control valve to introduce the vacuum into said vacuum chamber, thereby closing said fuel supply valve.

5. A device according to claim 4, wherein said gear transmission comprises an automatic gear transmission, said neutral-gear-condition detector comprising a neutral-gear detector for detecting the neutral-gear position of said automatic gear transmission to produce a high-level signal, a parking-gear detector for detecting the parking-gear position of said automatic gear transmission to produce a high-level signal, and a NOR gate having input terminals connected to said neutral-gear detector and said parking-gear detector for applying a low-level signal to said AND gate in response to said high-level signals from said neutral-gear detector and said parking-gear detector.

6. A device according to claim 5, wherein said electric control circuit further includes a car-speed sensor connected to said AND gate for detecting a speed of an automobile carrying said engine to produce a low-level signal, a second AND gate, an engine r.p.m. sensor connected to said second AND gate for detecting r.p.m. of said engine to produce a high-level signal, an intake-air temperature sensor connected to said second AND gate for detecting an intake-air temperature to produce a high-level signal, and an OR gate connected between said first-mentioned and second AND gates and said base of the transistor.

7. A device according to claim 6, wherein said neutral-gear-condition detector is connected to an input terminal of said second AND gate.

8. A device for controlling the increased fuel supply to an internal combustion engine in an automobile, comprising, fuel supply means selectively operable for causing an increased fuel supply to the engine, first sensor means for detecting a low engine temperature, second sensor means for detecting a neutral condition of a transmission of the automobile, and control means for operating said fuel supply means to cause an increase in fuel supply upon said first sensor means detecting a low engine temperature and to stop the increase in fuel supply upon said second sensor means detecting said neutral condition of the transmission.

9. The device of claim 8 for an automatic transmission wherein said second sensor means also detects a park condition of the transmission.

10. The device of claim 8 wherein said fuel supply means includes a vacuum controlled valve for controlling the increase of fuel supply, and said control means includes a valve for controlling the vacuum applied to said vacuum controlled valve.

11. A device for controlling the increased fuel supply to an internal combustion engine in an automobile, comprising, fuel supply means selectively operable for causing an increased fuel supply to the engine, first sensor means for detecting a low engine temperature, second sensor means for detecting a second operating condition of the engine and automobile other than engine temperature, third sensor means for detecting ambient air temperature, and control means for operating said fuel supply means to cause an increase in fuel supply upon said first sensor means detecting a low engine temperature and to stop the increase in fuel supply upon said second sensor means detecting said other operating condition, said control means also operating said fuel supply means to cause an increase in fuel supply upon said third sensor means detecting an ambient air temperature below a predetermined air temperature regardless of the second operating condition sensed by the second sensor means.

12. The device of claim 11 wherein said third sensor means also detects engine speed for only causing said increase in fuel supply below a predetermined engine speed.

* * * * *